US005618071A

United States Patent [19]

Aoki

[11] Patent Number: 5,618,071

[45] Date of Patent: Apr. 8, 1997

[54] CONSTRUCTION FOR SECURING AN ATTACHMENT DEVICE OF A MAGNETIC LOCK DEVICE IN A PREDETERMINED ORIENTATION

[75] Inventor: Yoshihiro Aoki, Tokyo, Japan

[73] Assignee: Application Art Laboratories Co., Ltd., Tokyo, Japan

[21] Appl. No.: 364,124

[22] Filed: Dec. 27, 1994

[51] Int. Cl.[6] ..... E05C 17/56

[52] U.S. Cl. ..... 292/251.5; 292/DIG. 50; 24/303

[58] Field of Search ..... 292/251.5, DIG. 50; 24/303

[56] References Cited

U.S. PATENT DOCUMENTS

| | | | |
|---|---|---|---|
| 4,458,395 | 7/1984 | Aoki | 292/251.5 X |
| 4,480,361 | 11/1984 | Morita | 24/303 |
| 4,825,526 | 5/1989 | Shenier | 24/303 |
| 4,991,270 | 2/1991 | Aoki | 292/251.5 X |
| 5,152,035 | 10/1992 | Morita | 24/303 |
| 5,249,338 | 10/1993 | Aoki | 24/303 |

FOREIGN PATENT DOCUMENTS

| | | | |
|---|---|---|---|
| 1519246 | 7/1978 | United Kingdom | 292/251.5 |

*Primary Examiner*—Rodney M. Lindsey
*Assistant Examiner*—Monica E. Millner
*Attorney, Agent, or Firm*—Wenderoth, Lind & Ponack

[57] ABSTRACT

A fastening construction for an attachment device of a magnetic lock device including a first element and a second element which may be magnetically coupled and decoupled is disclosed. The fastening construction permits the attachment device to be fastened to either or both of the first and second elements by orientating the attachment in the particular direction relative to the first and/or second elements. The attachment device includes a base plate having a protrusion to be attached to one side of at least one of the first and second elements, and a pair of legs extending therefrom in parallel with each other. On one side of the first and/or second elements, and a pair of legs extending therefrom in parallel with each other. On one side of the first and/or second elements, a recess is provided for engaging the protrusion on the base plate therein, thereby securing the base plate in the fixed position and orientating the same in the particular direction with regard to the attachment device.

11 Claims, 4 Drawing Sheets

CONSTRUCTION FOR SECURING AN ATTACHMENT DEVICE OF A MAGNETIC LOCK DEVICE IN A PREDETERMINED ORIENTATION

BACKGROUND OF THE INVENTION

1. Field of the Invention

The present invention relates to a construction for fastening the attachment in its secure position to a magnetic lock device or other similar devices.

2. Description of the Prior Art

A conventional magnetic lock device is used on articles such as bags, handbags and the like for closing or opening the bag, for example, by magnetically coupling or decoupling the body and flap of the article. The conventional magnetic lock device has the various constructions.

The prior art magnetic lock device is shown in FIG. 5, and it makes use of the magnetic attraction supplied by the permanent magnet incorporated therein. As shown in FIG. 5, it includes a first element A and a second element B. The first element A provides the magnetic attraction, and includes an annular permanent magnet 1, a ferromagnetic plate 3 disposed on the side 2 of a first polarity of the magnet 1, and a covering 4 enclosing the magnet 1 and ferromagnetic plate 3. The magnet 1 has a central bore 5, and the ferromagnetic plate 3 has a first ferromagnetic rod 6 extending centrally therefrom and into the central bore 5. The second element B that is magnetically attracted by the first element A includes a ferromagnetic plate 8 that is provided to face opposite the opposite polarity 7 of the magnet 1 and has a second ferromagnetic rod 9 extending centrally therefrom. Thus, when the first and second elements A and B are to be magnetically coupled together, the ferromagnetic plate 8 may be magnetically attracted by the magnet 1 on the first element A through the covering 4, and the second ferromagnetic rod 9 may be inserted into the central bore 5 where it meets the first rod 6 and engages it.

Each of the first and second elements A and B has a respective attachment 11, 11 on the outer side 10 thereof that allows it to be mounted to the respective correponding part, e.g., the body or flap of a bag, handbag and similar article.

The attachment 11 on each of the prior art elements A and B also has various types. For example, the type shown in FIG. 5 includes a base plate 12 attached to the outer side 10 and having a through hole 12*a*, and a pair of legs 13, 13 extending perpendiculary to the base plate 12 and in parallel with each other. To permit the attachment 11 to be fastened to each respective one of the first and second elements A and B, each of the first and second ferromagnetic rods 6, 9 has a rivet 6*a*, 9*a* that may be passed through each respective one of through holes 3*a*, 8*a* provided centrally in each respective one of the ferromagnetic plates 3, 8 and then passed through the through hole 12*a* in the base plate 12. Then, the portion of each respective rivet 6*a*, 9*a* exposed from each respective base plate 12 may be pressed and flattened as shown at 14. In this way, the respective ferromagnetic plates 3, 8, the respective ferromagnetic rods 6, 9 and the respective attachments 11, 11 may be combined together as a single unit.

The prior art attachment 11 as described above has the following constructional problems. In assembling the respective ferromagnetic plates 3, 8, the respective ferromagnetic rods 6, 9 and the respective attachments 11, 11 together, they may rotate freely about the respective rivets 6*a*, 9*a* which are not yet pressed and flattened at 14. Thus, it often happens that the respective pairs of legs 13 and 13 on the attachment 11 may be orientated in any direction, or may not be aligned properly, with regard to the respective ferromagnetic plates 3, 8 when the attachments 11, 11 are fastened by pressing and flattening the respective rivets 6*a*, 9*a*.

The above problem may not apply for the ferromagnetic plates 3, 8 which,have a simple round shape. It is clear, however, that there is the problem when the ferromagnetic plates 3, 8 have a square, hexagonal, octagonal or any other polygonal shape, or when the second element B carries any characters, figures or meaningful symbols on the inner side 15 thereof. In this case, when the first and second elements A and B are mounted to the corresponding parts of an article, such as the body and flap of a bag or handbag, the respective ferromagnetic plates 3, 8 may be orientated in different directions in relation to the body and flap, respectively, depending upon whether or not the respective ferromagnetic plates 3, 8 are aligned with the respective pairs of legs 13, 13 on the attachments 11, 11 when the attachments are completely fastened to the respective ferromagnetic plates by pressing and flattening the respective rivets as shown at 14. Thus, it is difficult or almost impossible to ensure that the first and second elements A and B are fixed in their predetermined positions on the body and flap when the respective attachments 11, 11 are fastened to the above respective positions.

SUMMARY OF THE INVENTION

The present invention overcomes the problems of the prior art as described above, by providing the construction for fastening the attachments in their respective fixed positions to the first and second elements A and B so that the attachments can be orientated in one particular predetermined direction with regard to the respective corresponding ferromagnetic plates when they are completely fastened to the ferromagnetic plates.

The fastening construction according to the present invention may be used on a magnetic lock device that includes a first element and a second element that may be magnetically coupled and decoupled. Specifically, the fastening construction may be provided for the attachment on either or both of the first and second elements, and may include a base plate attached to the outer side of the particular element, and a pair of legs extending perpendiculary from the base plate and in parallel with each other. The base plate has a protrusion extending therefrom, and the ferromagnetic plate on the first or second element has a recess on the outer side thereof for accepting the protrusion therein and engaging the same when the protrusion enters the recess.

The number of the protrusion and corresponding recess may be one, or two or more, respectively.

According to the fastening construction of the present invention, the attachment can be fastened to the corresponding element by allowing the protrusion to engage the recess such that the pair of legs can be aligned in the particular direction with regard to the ferromagnetic plate on the first or second element. Thus, once the attachment is fastened to the element, it can be orientated in the particular direction and secured in that direction.

BRIEF DESCRIPTION OF DRAWINGS

Those and other objects, advantages, and features of the present invention will become apparent from the detailed description of several preferred embodiments that follows herein by reference to the accompanying drawings, in which:

FIG. 3*b* is a sectional view of the attachment;

DETAILED DESCRIPTION OF PREFERRED EMBODIMENTS

Figure 1A:
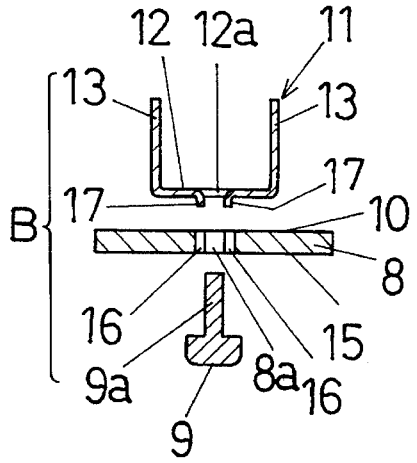
FIGS. 1*a* through 1*g* illustrate one preferred embodiment of the present invention in which the fastening construction is provided on the second element, or the magnetically attracted part, of the magnetic lock device, FIG. 1*a* being an exploded sectional view of the second element, FIG. 1*b* being a plan view of the ferromagnetic plate, FIG. 1*c* being a bottom view of the ferromagnetic plate, FIG. 1*d* being a plan view of the attachment, FIG. 1*e* being a side view of the attachment, FIG. 1*f* being a sectional view of the second element, and FIG. 1*g* depicting how the second element is mounted to the flap of the handbag.
Figure 1B:
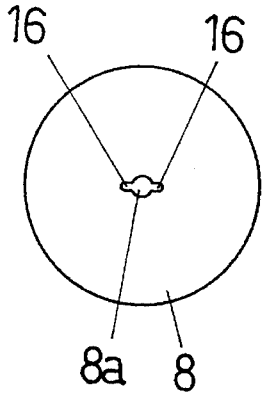

The present invention is now described in further detail by referring to particular preferred embodiments shown in the figures.

Referring first to FIGS. 1*a* through 1*g*, the present invention may be applied to the second element B, or the magnetically attracted part, of the prior art magnetic lock device described above in the section "Description of the Prior Art". In the second element B including a ferromagetic plate 8, a second ferromagnetic rod 9 and a attachment or attachment device 11, the improvement includes the ferromagnetic plate 8 having a central through hole 8*a* having recesses 16, 16 formed on the diametrically opposed sides thereof and extending laterally and transversely, the second ferromagnetic rod 9 having a diametrically smaller rod 9*a* extending therefrom and which may pass through the central through hole 8*a* (see FIG. 1*b*), and the attachment 11 including a base plate 12 having a pair of legs 13, 13 and a central bore 12*a* formed for receiving the rod 9*a* therethrough and having a pair of protrusions 17, 17 formed on the opposite sides of the bore 12*a* corresponding to the above recesses 16, 16 (in parallel with the legs 13, 13). Those protrusions may be formed by punching out part of the base plate 12 and bending that part downwardly (see FIGS. 1*d*and 1*e*).

Figure 1C:
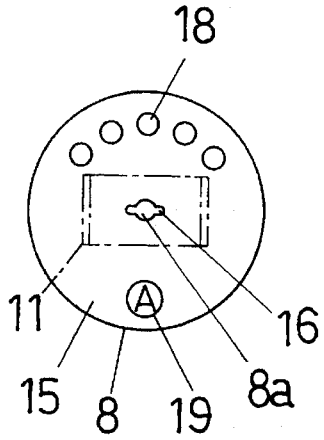
Figure 1D:
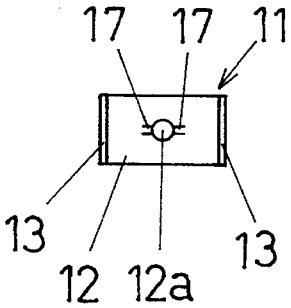
Figure 1E:
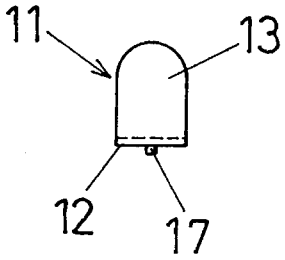
Figure 1F:
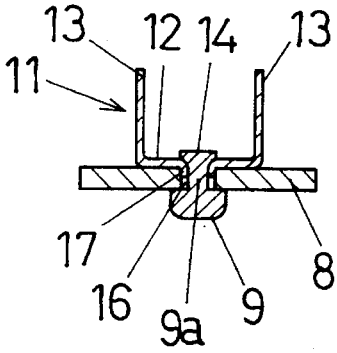

The ferromagnetic plate 8 may carry particular characters 18 or symbols 19 impressed on the inner side 15 around the peripheral margin thereof (see FIG. 1*c*).

In assembling the principal parts to constitute the second element B, the base plate 12 of the attachment 11 may be fastened to the outer side 10 of the ferromagnetic plate 8 in the following steps. First, the protrusions 17, 17 on the base plate 12 are engaged into the corresponding recesses 16, 16. Then, the rod 9*a* of the second ferromagnetic rod 9 is inserted into the through hole 8*a* in the plate 8 and then into the bore 12*a* in the base plate 12. Finally, the portion of the rod 9*a* extending above the base plate 12 is pressed and flattened like the rivet as shown at 14. Upon completion of those steps, the second element B is completed, including the ferromagnetic plate 8, the second ferromagnetic rod 9 and the attachment 11 which are assembled together as a single unit (see FIG. 1*f*).

According to the embodiment described above, the ferromagnetic plate 8 and the attachment 11 can be secured in the fixed position and prevented from rotation relative to each other, by allowing the protrusions 17, 17 on the attachment 11 to engage into the corresponding recesses 16 on the ferromagnetic plate 8. Thus, the pair of legs 13, 13 can be aligned in the particular direction with regard to the characters 18 or symbols 19 on the inner side 15, as indicated by the dot-dash line in FIG. 1*c*.

Figure 1G:
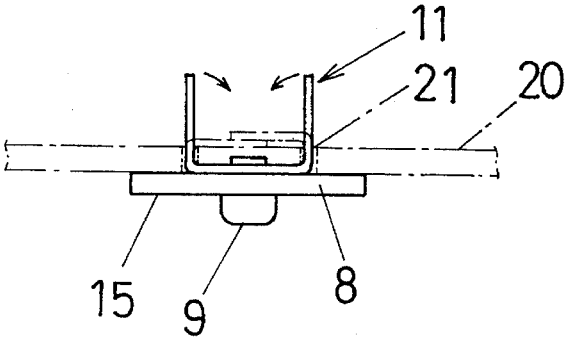

For example, when the second element B of the invention is to be mounted to the flap 20 of the handbag as shown in FIG. 1*g*, a pair of apertures 21, 21 may be provided on the flap 20 at the positions corresponding to those of the pair of legs 13, 13, through which the legs 13, 13 may be inserted. In this way, the ferromagnetic rod 9 on the inner side 15 of the ferromagnetic plate 8 can be fixed by the attachment 11 so that it can be orientated in the particular direction with regard to the flap 20.

Figure 2A:
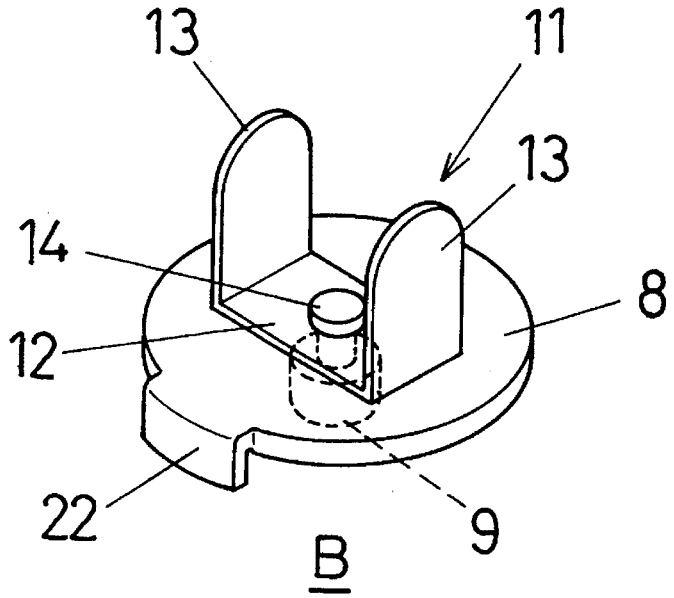
FIGS. 2*a* and 2*b* illustrate a variation of the ferromagnetic plate in the embodiment of FIG. 1, FIG. 2*a* being a perspective view and FIG. 2*b* being a front view.
Figure 2B:
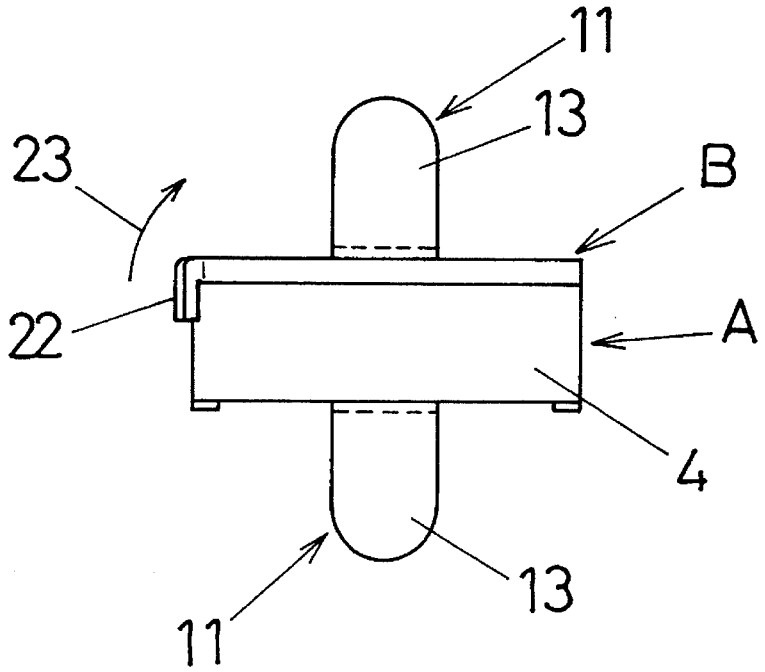

In some particular cases where the coupling strength between the first and second elements A and B should be increased against any stress applied thereto from the outside, the ferromagnetic plate 8 may be provided with a projection 22 extending from the marginal edge on one side, as shown in FIGS. 2*a* and 2*b*. In those cases, the attachment 11 must be orientated in a particular direction with regard to the ferromagnetic plate 8, and the second element B must be mounted to the article like the handbag in such a way that it can be orientated in the particular direction. Those needs can be met by the combination of the recesses 16 and protrusions 17 that may engage each other, respectively.

The above description has been made for the second element B in particular, and it may also apply for the first element A where the ferromagnetic plate 8 and the attachment 11 may have the same construction as those for the second element B.

Figure 3A:
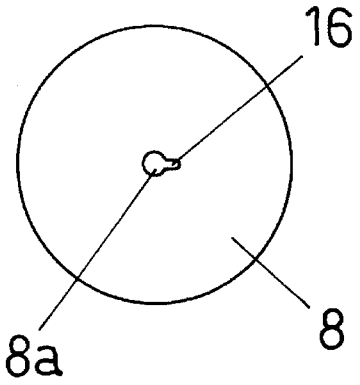
FIGS. 3*a* and 3*b* illustrate another preferred embodiment in which the fastening construction is provided on the second element of the magnetic lock device, FIG. 3*a* being a plan view
Figure 3B:
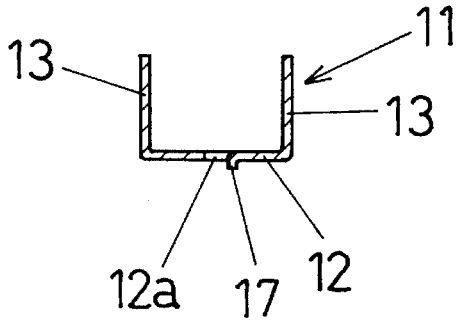

Referring to FIGS. 3*a* and 3*b*, a variation of the preceding embodiment is shown, in which a single recess 16 and a single protrusion 17 are provided. Specifically, the recess 16 is provided on one side of the through hole 8*a* in the ferromagnetic plate 8, and the protrusion 17 is provided on one side of the through hole 12*a* formed in the base plate 12 of the attachment 11.

Figure 4A:
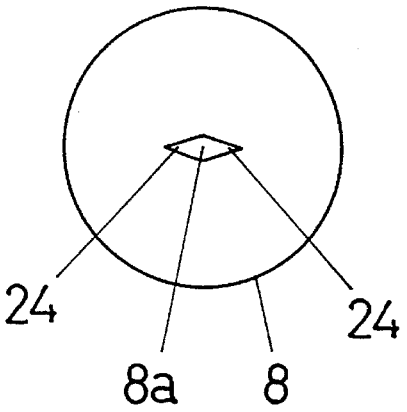
FIGS. 4*a* through 4*c* illustrate a further preferred embodiment in which the fastening construction is provided on the second element of the magnetic lock device, FIG. 4*a* being a plan view of the ferromagnetic plate, FIG. 4*b* being a sectional view of the attachment, and FIG. 4*c* being a plan view of the attachment.
Figure 4B:
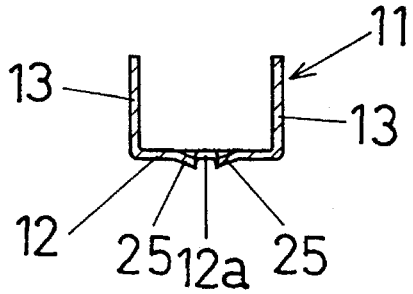
Figure 4C:
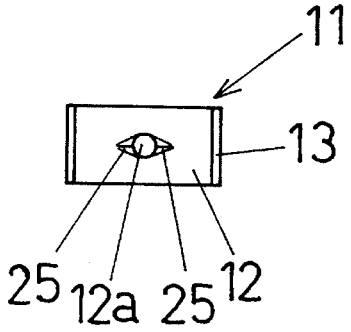
Figure 5:
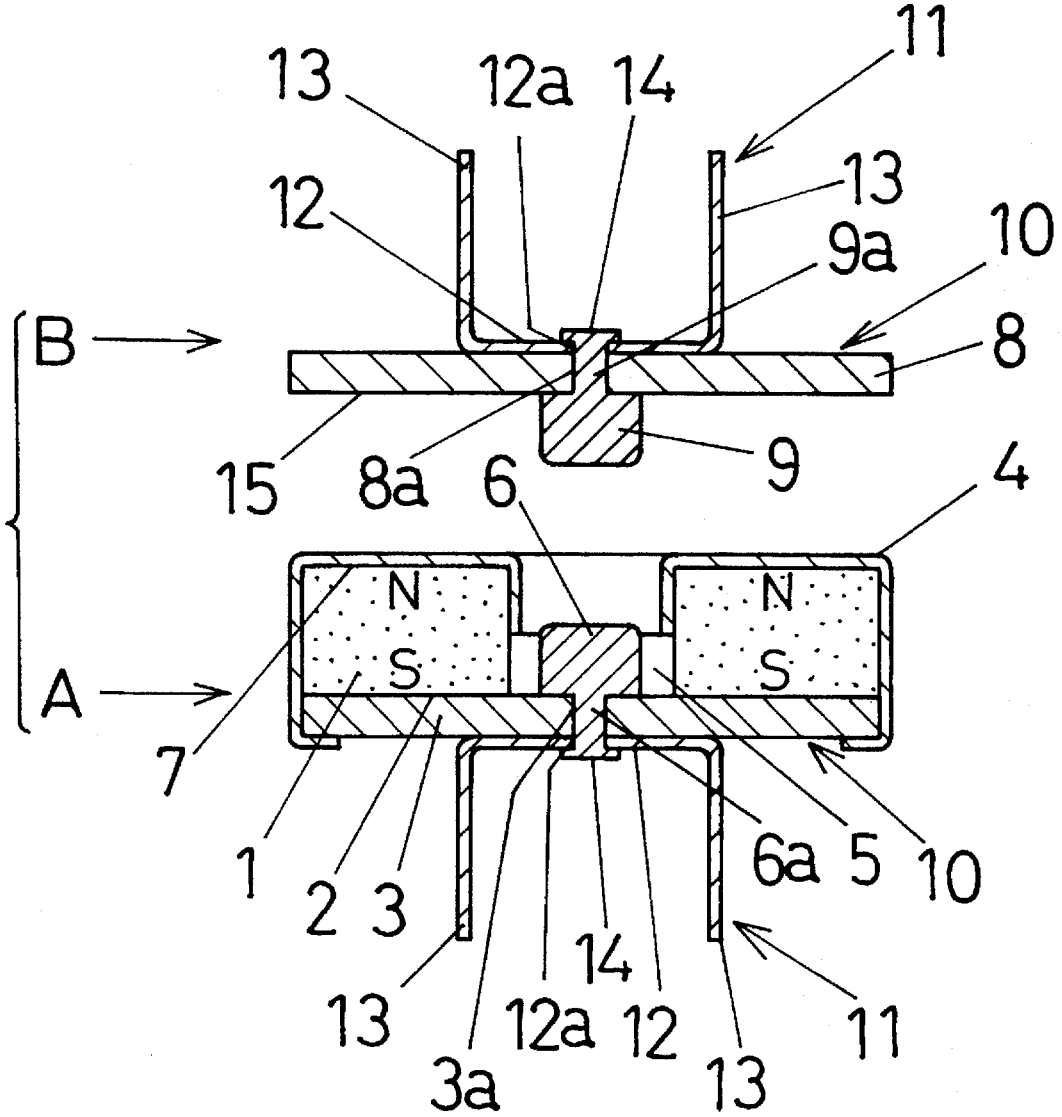
FIG. 5 is a sectional view of the magnetic lock device of the prior art.

Referring to FIGS. 4*a* through 4*c*, a further variation is provided in which the recess and projection have a different shape from those in the preceding embodiment, respectively. Specifically, a pair of recesses 24, 24 are provided on the diametrically opposed sides of the the marginal edge of the through hole 8*a* in the ferromagnetic plate 8, and are formed into a triangular shape in plane. Correspondingly, a pair of protrusions 25, 25 are provided on the marginal edge of the through hole 12*a* in the base plate 12 of the attachment 11, and are formed into a V shape in cross section by deforming the marginal edge of the hole 12*a* into the V shape in cross section.

According to the variations shown in FIGS. 3*a* and 3*b* and FIGS. 4*a*, 4*b* and 4*c*, the respective protrusions 17, 25 on the base plate 12 of the attachment 11 may engage into the corresponding respective recesses 16, 24 on the ferromagnetic plate 8, thereby securing the attachment 11 to the ferromagnetic plate 8. In this way, the attachment 11 can be orientated in the particular direction with regard to the ferromagnetic plate 8.

In the described embodiments, all of the recesses 16, 24 are formed such that they extend through the full thickness of the respective ferromagnetic plate 8. Alternatively, those recesses may be formed such that they extend halfway through the thickness of the ferromagnetic plate. In either case, the recesses can accept the protrusions on the attachment, ensuring that the rotation of them relative to each other can be restricted by engaging each other when they are rotated relative to each other. As a variation of the embodiment in FIGS. 4*a* to 4*c*, the number of the recesses 24 and protrusions 25 may be one, respectively.

Accordingly, when the attachment is to be fastened to either or both of the first and second elements A and B, the attachment can be orientated in the particular direction relative to the first or second element by engaging the protrusion on the attachment with the recess on the first or second element. Thus, the first or second element can be orientated in the particular direction relative to the part of an article such as the flap of the handbag, for example, when the first or second element is being mounted to the flap. This permits the first or second element to be secured in the particular position relative to the article. Thus, the first and second elements can perform their locking functions.

Although the present invention has been described in terms of the particular embodiments thereof, it should be understood that various changes and modifications may be made within the scope and spirit of the invention as defined in the appended claims.

What is claimed is:

1. A magnetic fastener device comprising:

a ferromagnetic plate having a central hole therethrough and first and second opposing faces;

an attachment device including a base plate having a central hole therethrough and first and second opposing faces, and a pair of legs fixed to said base plate and extending therefrom, said base plate being mounted parallel to said ferromagnetic plate with said first face of said base plate facing toward said second face of said ferromagnetic plate and such that said legs extend in a direction away from said ferromagnetic plate;

wherein said ferromagnetic plate further includes at least one recess formed in said second face thereof, said at least one recess being continuous with said central hole of said ferromagnetic plate and extending radially outwardly therefrom; and wherein said base plate of said attachment device includes at least one projection extending from said first face of said base plate in a direction toward said ferromagnetic plate, said at least one projection respectively engaging in said at least one recess of said ferromagnetic plate to prevent rotation of said ferromagnetic plate relative to said base plate of said attachment device.

2. A magnetic fastener device as recited in claim 1, wherein said at least one recess formed in said second face of said ferromagnetic plate comprises two diametrically opposed recesses formed in said second face of said ferromagnetic plate.

3. A magnetic fastener device as recited in claim 1, wherein said at least one recess formed in said second face of said ferromagnetic plate is formed through said ferromagnetic plate.

4. A magnetic fastener device as recited in claim 1, further comprising a rivet having enlarged head portions at each end thereof, said rivet extending through said central holes of said base plate and said ferromagnetic plate such that said enlarged head portions are respectively disposed adjacent said first face of said ferromagnetic plate and said second face of said base plate, said rivet securing said base plate to said ferromagnetic plate.

5. A magnetic fastener device as recited in claim 1, wherein said ferromagnetic plate and said attachment device together constitute a first fastener device element, and a second fastener device element is provided and is magnetically attractable to said first fastener device element, said second fastener device element comprising:

a second ferromagnetic plate having a central hole therethrough and first and second opposing faces; and a second attachment device including a second base plate having a central hole therethrough and first and second opposing faces, and a pair of legs fixed to said second base plate and extending therefrom, said second base plate being mounted parallel to said second ferromagnetic plate with said first face of said second base plate facing toward said second face of said second ferromagnetic plate and such that said legs of said second attachment device extend in a direction away from said second ferromagnetic plate.

6. A magnetic fastener device as recited in claim 5, wherein said second fastener device element further comprises an annular permanent magnet mounted to said first face of said second ferromagnetic plate and coaxial with said central holes of said second ferromagnetic plate and said second base plate.

7. A magnetic fastener device comprising:

a ferromagnetic plate having a central hole therethrough and first and second opposing faces;

an attachment device including a base plate having a central hole therethrough and first and second opposing faces, and a pair of legs fixed to said base plate and extending therefrom, said base plate being mounted parallel to said ferromagnetic plate with said first face of said base plate facing toward said second face of said ferromagnetic plate and such that said legs extend in a direction away from said ferromagnetic plate;

a rivet having enlarged head portions at each end thereof, said rivet extending through said central holes of said base plate and said ferromagnetic plate such that said enlarged head portions are respectively disposed adjacent said first face of said ferromagnetic plate and said second face of said base plate, said rivet securing said base plate to said ferromagnetic plate;

wherein said ferromagnetic plate further includes at least one recess formed in said second face thereof at a radial position relative to said central hole of said ferromagnetic plate; and wherein said base plate of said attachment device includes at least one projection extending from said first face of said base plate in a direction toward said ferromagnetic plate, said at least one projection respectively engaging in said at least one recess of said ferromagnetic plate to prevent rotation of said ferromagnetic plate relative to said base plate of said attachment device.

8. A magnetic fastener device as recited in claim 7, wherein said at least one recess formed in said second face of said ferromagnetic plate comprises two diametrically opposed recesses formed in said second face of said ferromagnetic plate.

9. A magnetic fastener device as recited in claim 7, wherein said at least one recess formed in said second face of said ferromagnetic plate is formed through said ferromagnetic plate.

10. A magnetic fastener device as recited in claim 7, wherein said ferromagnetic plate and said attachment device together constitute a first fastener device element, and a second fastener device element is provided and is magnetically attractable to said first fastener device element, said second fastener device element comprising:

a second ferromagnetic plate having a central hole therethrough and first and second opposing faces; and a second attachment device including a second base plate having a central hole therethrough and first and second opposing faces, and a pair of legs fixed to said second base plate and extending therefrom, said second base plate being mounted parallel to said second ferromagnetic plate with said first face of said second base plate facing toward said second face of said second ferromagnetic plate and such that said legs of said second attachment device extend in a direction away from said second ferromagnetic plate.

11. A magnetic fastener device as recited in claim 10, wherein said second fastener device element further comprises an annular permanent magnet mounted to said first face of said second ferromagnetic plate and coaxial with said central holes of said second ferromagnetic plate and said second base plate.

* * * * *